US006735790B1

(12) United States Patent
Willson et al.

(10) Patent No.: US 6,735,790 B1
(45) Date of Patent: May 18, 2004

(54) VENT STACK SCREEN FOR PORTABLE TOILET HOLDING TANKS

(76) Inventors: Donald V. Willson, 1077 Bluff Rd., Apalachicola, FL (US) 32320; June Willson, 1077 Bluff Rd., Apalachicola, FL (US) 32320

( * ) Notice: Subject to any disclaimer, the term of this patent is extended or adjusted under 35 U.S.C. 154(b) by 0 days.

(21) Appl. No.: 10/320,532

(22) Filed: Dec. 17, 2002

(51) Int. Cl.[7] ..... E03D 9/04

(52) U.S. Cl. ..... 4/218; 4/209; 4/321; 4/347; 4/449

(58) Field of Search ..... 4/209, 218, 321, 4/347, 449, DIG. 12; 454/271, 260, 243, 248

(56) References Cited

U.S. PATENT DOCUMENTS 4,184,414 A * 1/1980 Jarnot ..... 454/275
4,922,557 A * 5/1990 Harding et al. ..... 4/477
5,341,767 A * 8/1994 Smith ..... 122/13.01
5,535,559 A * 7/1996 Nielsen et al. ..... 52/199
6,374,425 B2 * 4/2002 Downey ..... 4/218
2002/0092631 A1 7/2002 Cavazos
2003/0110554 A1 * 6/2003 Hernandez ..... 4/218

* cited by examiner

*Primary Examiner*—Henry Bennett
*Assistant Examiner*—Azadeh Kokabi
(74) *Attorney, Agent, or Firm*—Richard C. Litman

(57) ABSTRACT

A vent stack screen for portable toilet holding tanks is provided in the form of a cap designed to fit over the open end of an open air vent stack extending from the holding tank through the roof of a portable toilet. The cap is constructed from a tubular sleeve of plastic material having an inner diameter substantially equal to the outer diameter of the vent stack of a holding tank. The cap includes an inwardly extending annular lip formed at one end. A circular mesh of plastic screen material is secured within the tubular sleeve between the annular lip and a plastic locking ring received within the tubular sleeve.

11 Claims, 3 Drawing Sheets

VENT STACK SCREEN FOR PORTABLE TOILET HOLDING TANKS

BACKGROUND OF THE INVENTION

1. Field of the Invention

The present invention relates to a vent stack screen for portable toilet holding tanks.

2. Description of the Related Art

A frequent problem with using out door portable johns and toilets is dealing with troublesome flying insects that enter the confined space of the toilet through the holding tanks. Another problem is flying or falling debris accumulating in the holding tanks.

Insect screens in the prior art has taken many forms, for example, published U.S. patent application Ser. No. 2002/0092631 A1 teaches a screen for blocking insects from entry into vent holes provided in brick walls. A, mesh of screen material includes a retainer with resilient fingers for engaging the vent hole to retain the screen over the vent hole.

None of the above inventions and patents, taken either singularly or in combination, is seen to describe the instant invention as claimed. Thus a vent stack screen for portable toilet holding tanks solving the aforementioned problems is desired.

SUMMARY OF THE INVENTION

The present invention provides a vent stack screen for holding tanks in the form of a cap designed to fit over the top of the open air vent stack extending from the holding tank through the roof of a portable toilet. The cap is constructed from a tubular sleeve of plastic material having an inner diameter substantially equal to the outer diameter of the vent stack of a holding tank. The cap includes an inwardly extending annular lip formed at one end. A circular mesh of plastic screen material is secured within the tubular sleeve between the annular lip and a plastic locking ring removably received within the tubular sleeve.

Accordingly, it is a principal object of the invention to provide a vent stack screen for holding tanks It is another object of the invention to provide a screen which prevents flying insects from entering a portable toilet through the holding tank.

It is a further object of the invention to provide a vent stack screen which also prevents flying insects and other debris from becoming lodged within vent stacks and preventing proper ventilation of the holding tank of portable toilets.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
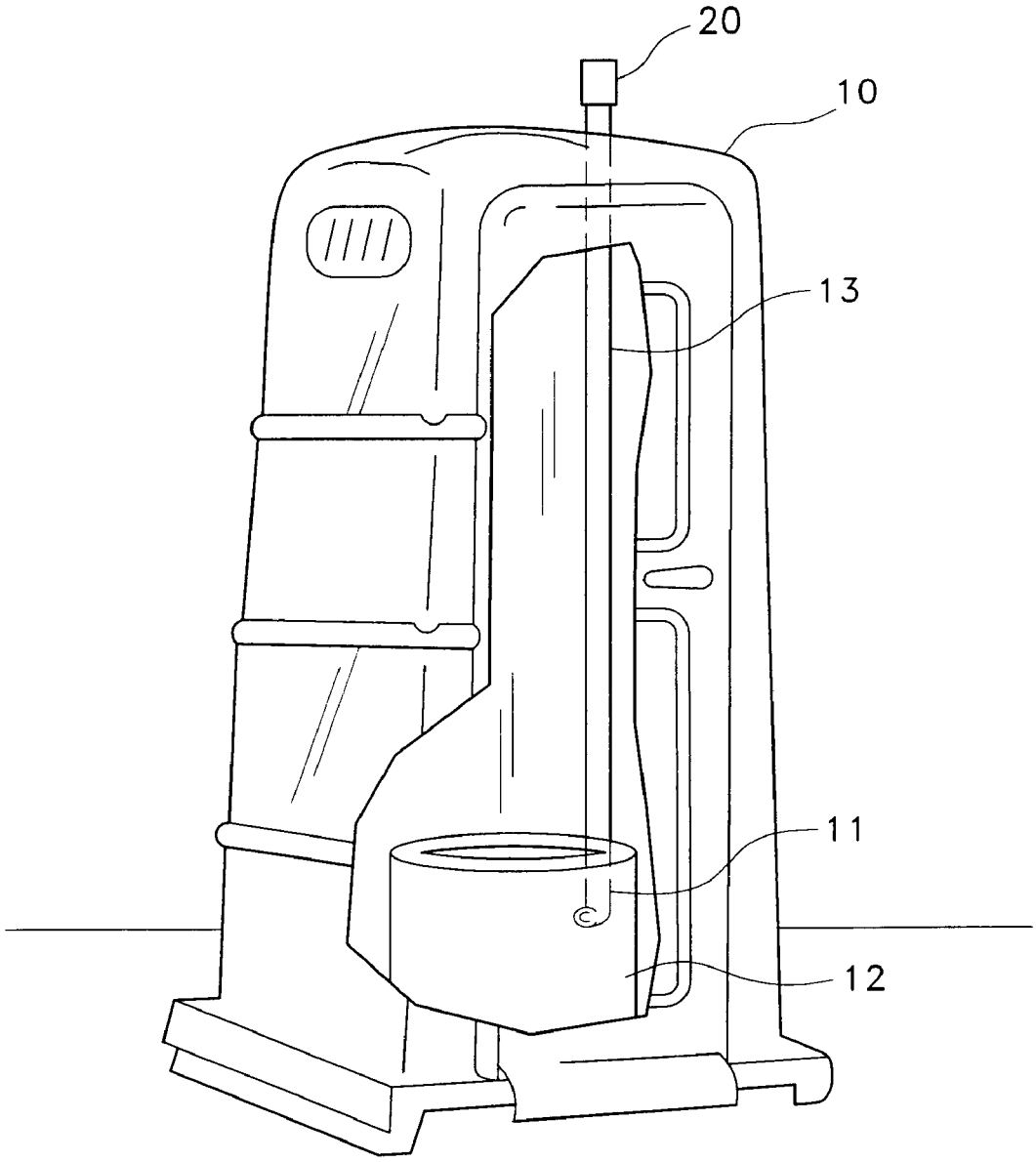
FIG. 1 is an environmental, perspective view of a vent stack screen according to the present invention installed on the vent stack of a portable toilet.

The present invention is a vent stack screen designed to snugly fit over the top of an open-air vent stack 13. FIG. 1 shows that the vent stack 13 of a portable toilet 10 is connected to an opening 12 in a holding tank 11 and extends through the roof of the portable toilet 10.

Figure 2:
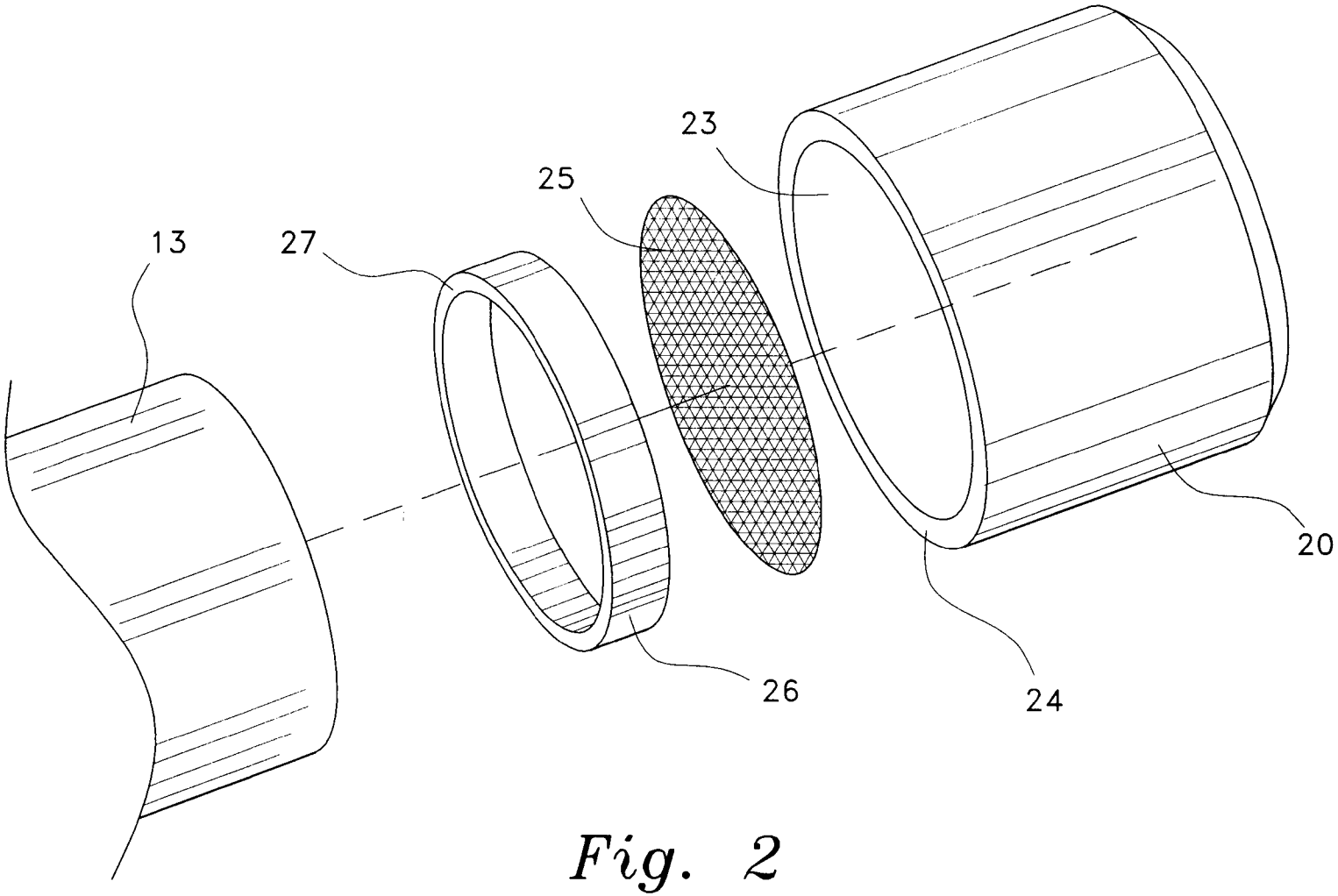
FIG. 2 is a perspective view of the fully assembled vent stack screen according to the present invention.

A cap 20 is mounted on the top of the vent stack. The cap 20 is constructed from tubular sleeve 24 of a plastic material having an inner diameter substantially equal to the outer diameter of the vent stack 13 of a holding tank 11. As best seen in FIG. 2, the cap 20 is formed with an inwardly extending annular lip 21 at one end.

Figure 3:
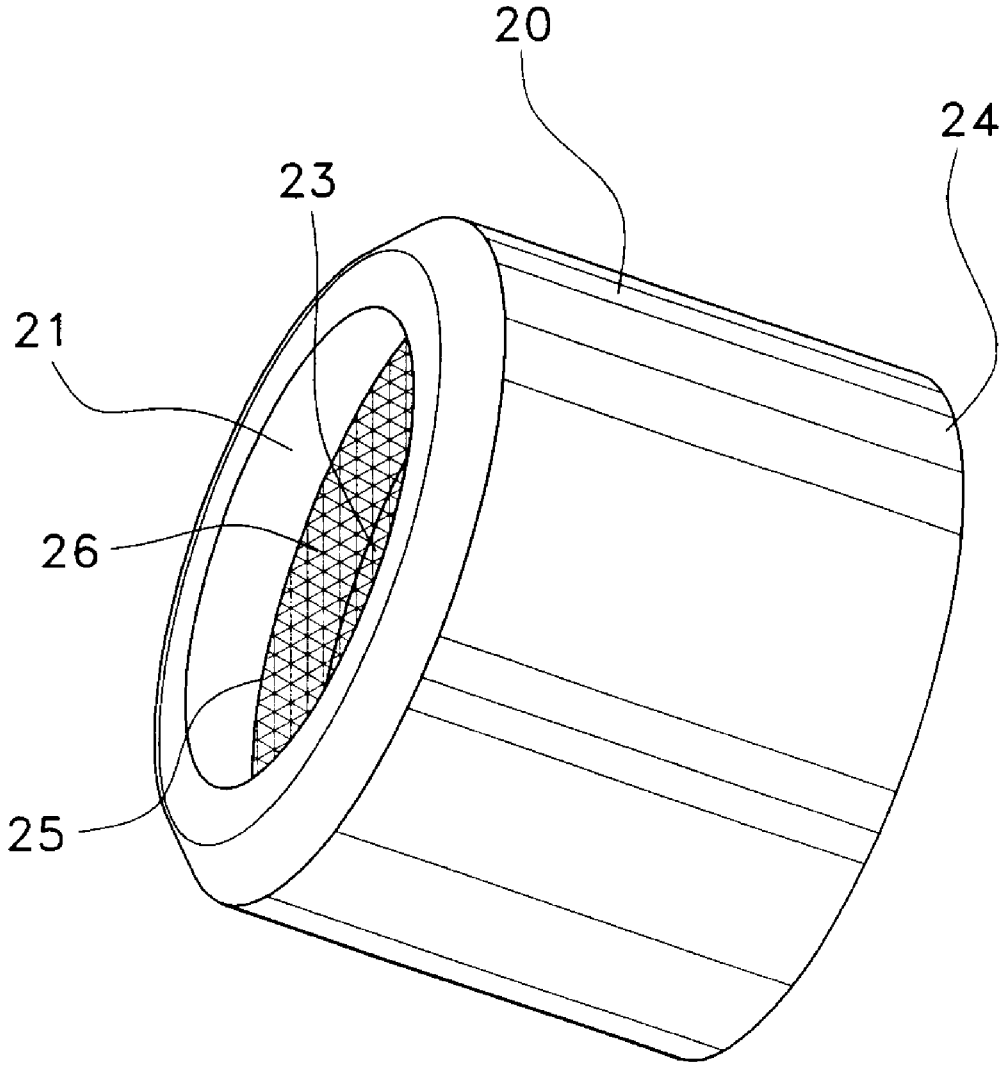
FIG. 3 is an exploded view of the vent stack screen according to the present invention.

FIG. 3 shows a circular mesh 25 of plastic screen material which is provided for preventing flying insects from entering the cap 20. The mesh 25 is secured within the interior 23 of the tubular sleeve 24 between the inner face of the annular lip 21 and one face 27 of a locking ring 26 which is removably received within the interior 23 of the tubular sleeve 24.

The cap 20 is placed over the end of the vent stack 13 and positioned so that the upper end of the vent stack engages the second face of the locking ring 26 within the cap 20. Thus, full venting of the holding tank is maintained while flying insects and debris are effectively prevented from entering into a portable toilet through the holding tank supplied with the vent stack screen of the present invention.

In addition, insects and debris are further prevented from entering and clogging the vent stack and thereby blocking proper ventilation of the holding tank.

The locking ring 26 and tubular sleeve 24 are preferably formed from PVC material. The mesh 25 can be constructed from any suitable weather resistant plastic material.

It is to be understood that the present invention is not limited to the embodiment described above, but encompasses any and all embodiments within the scope of the following claims.

We claim:

1. A vent stack screen for portable toilet holding tanks comprising:

a tubular sleeve having top and bottom ends, the bottom end having an inner diameter substantially equal to the outer diameter of the vent stack of a holding tank, said tubular sleeve having an inwardly extending annular lip formed at the top end, the annular lip having an inner diameter smaller than the inner diameter of the bottom end of the sleeve;

a locking ring removably received within the interior of said tubular sleeve; and a circular mesh of screen material secured within the interior of the tubular sleeve, the mesh screen being clamped against said annular lip by said locking ring.

2. The vent stack screen according to claim 1, wherein the locking ring and tubular sleeve formed from a plastic material.

3. The vent stack screen of claim 2, wherein the plastic material is PVC material.

4. The vent stack screen of claim 3, wherein the mesh is constructed from a weather resistant plastic material.

5. A vent screen for covering a portable toilet holding tank vent stack comprising:

a tubular sleeve having top and bottom ends, the bottom end having an inner diameter permitting a close fit around the vent stack of a holding tank, said tubular sleeve having an inwardly extending annular lip formed at the top end, the annular lip having an inner diameter smaller than the inner diameter of the bottom end of the sleeve;

a locking ring positioned within the interior of said tubular sleeve; and a circular disk of screen material secured within the interior of the tubular, the circular disk being clamped against said annular lip by said locking ring.

6. The vent screen of claim 5, wherein said circular disk is constructed of a weather resistant plastic screen material.

7. The vent screen of claim 5, wherein said sleeve and said locking ring are formed of PVC material.

8. The vent screen of claim 7, wherein said circular disk is constructed of a weather resistant plastic screen material.

9. The vent screen of claim 5, wherein said sleeve,locking ring and disk are formed of plastic materials.

10. The vent screen of claim 9, wherein said sleeve and said locking ring are formed of PVC material.

11. The vent screen of claim 10, wherein said circular disk is constructed of a weather resistant plastic screen material.

* * * * *